US007454887B2

(12) United States Patent
Harrison et al.

(10) Patent No.: US 7,454,887 B2
(45) Date of Patent: Nov. 25, 2008

(54) FOOTWEAR INTEGRATED STRAPLESS SPUR SYSTEM

(76) Inventors: Kelly Harrison, 3404 Merrimac Rd., Brentwood, CA (US) 90049; David Schneider, 3404 Merrimac Rd., Brentwood, CA (US) 90049

( * ) Notice: Subject to any disclaimer, the term of this patent is extended or adjusted under 35 U.S.C. 154(b) by 0 days.

(21) Appl. No.: 11/202,893

(22) Filed: Aug. 12, 2005

(65) Prior Publication Data

US 2007/0033910 A1 Feb. 15, 2007

(51) Int. Cl.
*A43C 17/04* (2006.01)

(52) U.S. Cl. ..... 54/83.1

(58) Field of Classification Search ..... 54/83.1, 54/83.2, 49.5; 36/74, 131–134
See application file for complete search history.

(56) References Cited

U.S. PATENT DOCUMENTS

| | | | | | |
|---|---|---|---|---|---|
| 1,665 | A | | 7/1840 | Warner et al. | |
| 3,142 | A | * | 6/1843 | Reinhardt | 54/83.1 |
| 39,106 | A | | 6/1863 | Langhols | |
| 78,667 | A | | 6/1868 | Herr | |
| 86,049 | A | | 1/1869 | Woodruff | |
| 105,671 | A | | 7/1870 | Gunn | |
| 113,152 | A | | 3/1871 | Fellows | |
| 111,880 | A | | 4/1871 | Schwandt | |
| 116,404 | A | | 6/1871 | Bohn | |
| 225,955 | A | | 3/1880 | Tytler | |
| 256,606 | A | | 4/1882 | Thomson | |
| 304,460 | A | * | 9/1884 | Schmidt | 54/83.2 |
| 308,413 | A | | 11/1884 | Kaino | |
| 376,832 | A | | 1/1888 | Schummel | |
| 450,512 | A | | 4/1891 | Hutt | |
| 635,948 | A | | 10/1899 | Turpin | |
| 694,421 | A | * | 3/1902 | Ridings | 54/83.2 |
| 701,854 | A | | 6/1902 | Davison | |
| 722,046 | A | | 3/1903 | Rieger | |
| 2,098,017 | A | | 11/1937 | Seyfarth | |
| 2,438,978 | A | | 4/1948 | Rosen | |
| 2,454,228 | A | | 11/1948 | Smith | |
| 3,157,013 | A | * | 11/1964 | Hayward et al. | 54/83.1 |
| 4,642,910 | A | | 2/1987 | Carter | |
| D352,805 | S | | 11/1994 | Martin | |
| 5,394,677 | A | | 3/1995 | Van Scoyk | |
| 6,339,915 | B1 | | 1/2002 | Bradbury | |
| 6,536,139 | B2 | | 3/2003 | Darley et al. | |
| 6,536,196 | B2 | | 3/2003 | Harrison et al. | |

(Continued)

FOREIGN PATENT DOCUMENTS

| | | |
|---|---|---|
| DE | 5848 | 12/1878 |

(Continued)

*Primary Examiner*—Son T. Nguyen
(74) *Attorney, Agent, or Firm*—Albert L. Jacobs, Jr.; Gerard F. Diebner; Dreier LLP

(57) ABSTRACT

A strapless spur system having a retainer attached to a boot or other footwear, a detachable base with a spring loaded plunger for secure attachment and detachment of the base to the retainer on the footwear. A preferred embodiment includes a mechanism built into the base which releasably engages the spur. The mechanism may be a spring lock which engages a void on the retainer. The spur assembly may have an upward or downward configured spur and the spur assembly may be engaged to the footwear with any of a number of reciprocal mating configurations.

19 Claims, 6 Drawing Sheets

U.S. PATENT DOCUMENTS

| | | | |
|---|---|---|---|
| 2003/0226287 | A1 | 12/2003 | Borne |
| 2005/0083239 | A1 | 4/2005 | Thudor et al. |

FOREIGN PATENT DOCUMENTS

| | | | |
|---|---|---|---|
| DE | 6549 | | 2/1879 |
| DE | 59076 | | 4/1891 |
| DE | 72313 | | 3/1893 |
| DE | 180197 | | 12/1905 |
| DE | 2840821 | | 4/1980 |
| FR | 2633494 | | 1/1995 |
| FR | 2736519 | | 1/1997 |
| FR | 2861222 | | 4/2005 |
| GB | 2336285 | A | 10/1999 |
| JP | 06189807 | | 7/1994 |

* cited by examiner

FOOTWEAR INTEGRATED STRAPLESS SPUR SYSTEM

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of equestrian equipment and more specifically to a footwear integrated strapless spur system.

Horseman and cowboys have long attached spurs to their boots as a practical and fashionable accessory. A conventionally designed English spur has a generally U-shaped metal member, referred to as a band that fits about the rear of the rider's boot adjacent the heel and has a rearward projection which often carries a point or a rowel having a multiplicity of points. In conventional designs, each English spur normally has one strap that is inserted through one end of the band, passed underneath the boot's heal, and passed through the opposite end of the band and serves to releasably attach the spur to the rider's boot. The typical spur mounting apparatus attaches firmly to the boot by the use of clamps, chain or the like, so as to rigidly hold the spurs in their proper position behind the heel of the boot.

Prior spur designs have included means to prevent the riding up of the spur to prevent misalignment of the spur and thus detracting from one of its purposes of stable engagement to the boot. Attaching additional upper straps to the band or including a ridge element that can be wedged between the heel of the boot and the upper portion of the boot are two examples of such designs.

These arrangements tend to allow the spur mounting apparatus to "ride-up" the boot, out of its useful position. To counteract this tendency boot wearers will increase the tension on the mounting apparatus sometimes cutting or otherwise damaging the boot leather.

Prior art solutions are many and varied but none have the inventive combination of the present invention. Examples of previous designs include:

U.S. Pat. No. 39,106 (Langholz) discloses a heel mounted spur which can be removably attached.

U.S. Pat. No. 78,667 (Herr) consists in providing a hollow heel, made of metal or any hard and suitable substance, which said hollow heel combines and contains, in parts or in one solid piece, the yoke or counter, the sole, and the heel proper.

U.S. Pat. No. 86,049 (Woodruff) is a combination of metallic boot-heel with sheathed spur, the parts being so constructed and operating, that while the spur will always be in place and ready for use, it will not be in the way of injuring the clothing, carpets, &c., or of receiving_injury from stones, or from the pavement.

U.S. Pat. No. 113,152 (Fellows) discloses a heel mounted spur which can be removably attached by means of a screw mounting on the boot heel or stirrup.

U.S. Pat. No. 116,404 (Bohn) discloses an adjustable heel mounted spur and the method by which the spur is attached to the heel.

U.S. Pat. No. 225,955 (Tytler) consists in a curved bifurcated support for the spur-wheel, having one end slotted to receive the screw by which it is fastened to the boot, and having ridges or serrations for insuring a firm hold on the boot-heel.

U.S. Pat. No. 256,606 (Thomson) consists of a spur having rigid thereon or integral therewith a shoulder which abuts against the heel, and has the face adjacent to the heel smooth, and of such form as to allow it to freely turn on the heel without defacing the exterior of same, a rigid attaching-screw projecting from said shoulder, and a set-screw or pin passing movable through the aforesaid shoulder, and bearing against the heel to prevent the spur from turning and working loose.

U.S. Pat. No. 450,512 (Hutt) shows a means for detachably securing a spur to the heel of a boot or shoe, whereby the spring-catch employed for retaining the spur is exposed at the breast of the heel of the boot or shoe, and is adapted to be operated at such point for releasing the catch, and thereby permitting the spur to be removed.

U.S. Pat. No. 701,854 (Davison) discloses a yoke comprising a single piece of spring metal and provided with a plurality of studs, a riding-spur carried by said yoke; in combination with the heel of a boot or shoe having chambers, exteriorly screw-threaded plugs occupying the outer portions of the chambers and forming sockets to receive said studs, a plunger slidably mounted in each plug and having headed ends, the inner headed end of the plunger extending through the inner end of the plug and occupying the inner portion of the plug-chamber and adapted to abut against said plug to limit the outward movement of the plunger, and a spring in the plug between the inner end of the plug and the outer headed end of the plunger, and adapted, when the studs are removed, to force the plunger outward to close the plug-socket, substantially in the manner set forth.

U.S. Pat. No. 722,046 (Rieger) relates to a fastening device for screws by means of which the drawback (damage to supporting material) is entirely avoided and a firm and secure gripping of the screw is obtained even when the support is made of a material of very little resistance.

U.S. Pat. No. 2,438,978 (Rosen) discloses a boot or shoe for children's wear suggestive, at least to a child, of the boots worn by rough riders or cowboys, having a high cut top and a spur at its heel. The child's boot has a soft spur which, in appearance, simulates the spurs worn by horsemen but which is made of an organic material too soft to cause injury either to the wearer or to objects with which it may come in contact.

U.S. Pat. No. 2,454,228 (Smith) discloses a spur which may be clipped on to a shoe or boot, and by reason of its construction, maintain itself in position on the said shoe or boot.

U.S. Pat. No. 4,642,910 (Carter, Jr. et. al.) discloses a boot provided with a depending rear heel and a rearwardly opening front-to-rear extending blind cavity is defined within the heel. A spur including an elongated shank having first and second end portions is provided and the first end portion of the shank of the spur is releasably latchingly receivable within the cavity defined in the boot. In addition, a decorative button is provided for releasable snap fitting engagement in the rear end of the cavity after the first end portion of the shank of the spur has been removed from the cavity.

U.S. Pat. No. D352,805 (Martin) discloses an ornamental design for a spur attached by insertion into the heel of a riding boot.

German Patent No. 5848 (Bonsack) discloses a traditionally styled western spur which attaches to a boot heel by means of a plurality of screws screwed into the boot heel.

German Patent No. 6549 (Steffen) discloses a heel mounted screw attached spur.

German Patent No. 59076 (Fried) discloses an arrangement for an adjustable spur where said spur attaches to the boot heel at two indentation points at the front end of the heel and secured in place by means of bolt which enters the rear of the heel holding the arrangement firmly in place.

German Patent No. 72313 (Hintze) discloses a spur where said spur attaches to the back of the boot heel by means of a male threaded bolt which passes through and traverses the length of the boot heel and is held firmly in place by a female threaded bolt.

German Patent No. 180197 (Ott) discloses a spur where said spur attaches to the back of the boot heel by means of a solid block bolt which passes through a portion of the boot heel and is held in place by means of a fastener introduced into the boot heel from above and passing through a hole in the block bolt to keep the spur in place.

U.S. Pat. No. 6,536,196 (Harrison et al.) shows a further example of an improved spur is shown that attaches a spur directly to a base or retainer built into the footwear, but fails to disclose or teach the inventive combination of the present invention.

None of the prior art shows the inventive system for attaching a boot spur to the boot as claimed herein.

BRIEF SUMMARY OF THE INVENTION

The primary advantage of the invention is to provide a spur system that is integrated with the footwear.

Another advantage of the invention is to provide a spur that can be removed from the attached footwear.

Another advantage of the invention is to provide a spur that maintains its optimal operating position (i.e. does not "ride up" or move out of position during use).

A further advantage of the invention is to provide a spur system that is integrated with the footwear and operates without a disc rowel.

Yet another advantage of the invention is to provide a spur system that is integrated with the footwear and reduces discomfort for the ridden animal.

Still yet another advantage of the invention is to provide a spur that can be easily detached when not in use.

The strapless spur is intended for use in specially manufactured footwear including boots, which have a fixed retainer is built into the footwear. The spur securely attaches to the retainer by means of one of a plurality of mechanisms installed in the base that when activated secures the spur to the base; and also secures the base to the retainer and thus the boot or footwear.

In accordance with a preferred embodiment of the invention, there is disclosed a strapless spur system having a retainer attached to an article of footwear, a spur assembly comprising a spur connected to a base for attachment to the retainer, a plunger in the base for the retainer for stable engagement of the spur assembly.

In accordance with a preferred embodiment of the invention, there is disclosed a strapless spur system having a retainer having a plurality of voids, the retainer vertically mounted on an article of footwear, a spur assembly having a spur and a base for stable attachment to the retainer, a spring lock in the base for stable attachment of the base and to the retainer, the base and the retainer each having a reciprocal cross sectional configuration to engage each other, and the spur assembly being adapted for stable engagement to the retainer.

In accordance with a preferred embodiment of the invention, there is disclosed a strapless spur system having a retainer attached to an article of footwear, a spur assembly having a spur and a base for stable attachment to the retainer, a spring lock in the base for stable attachment of the base and to the retainer, where the base Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
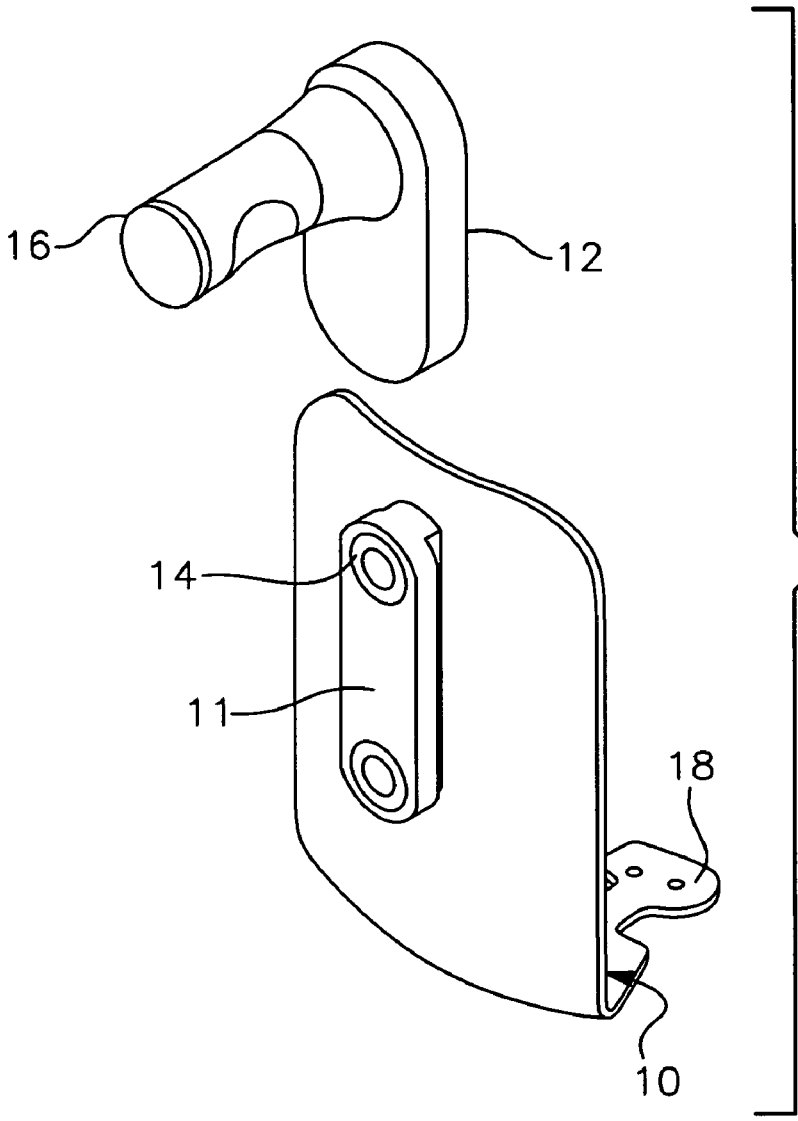
FIG. 1 is a perspective view of a preferred embodiment of the invention.

Referring now to FIG. 1 there is shown a perspective view of the butt (back area above the heel) of an article of footwear 10, exemplarily shown herein as a conventional boot. It is well understood in the art that such footwear may be a riding boot, a cowboy boot, or any other footwear upon which a spur may be advantageously used. This spur system does not rely on straps to attach the spur to the footwear and is preferably integrated into boot 10 and may be placed within the boot as part of the manufacturing process. In certain situations, it may be advantageous to retrofit an existing boot and still achieve the same overall benefits of the invention.

Figure 2:
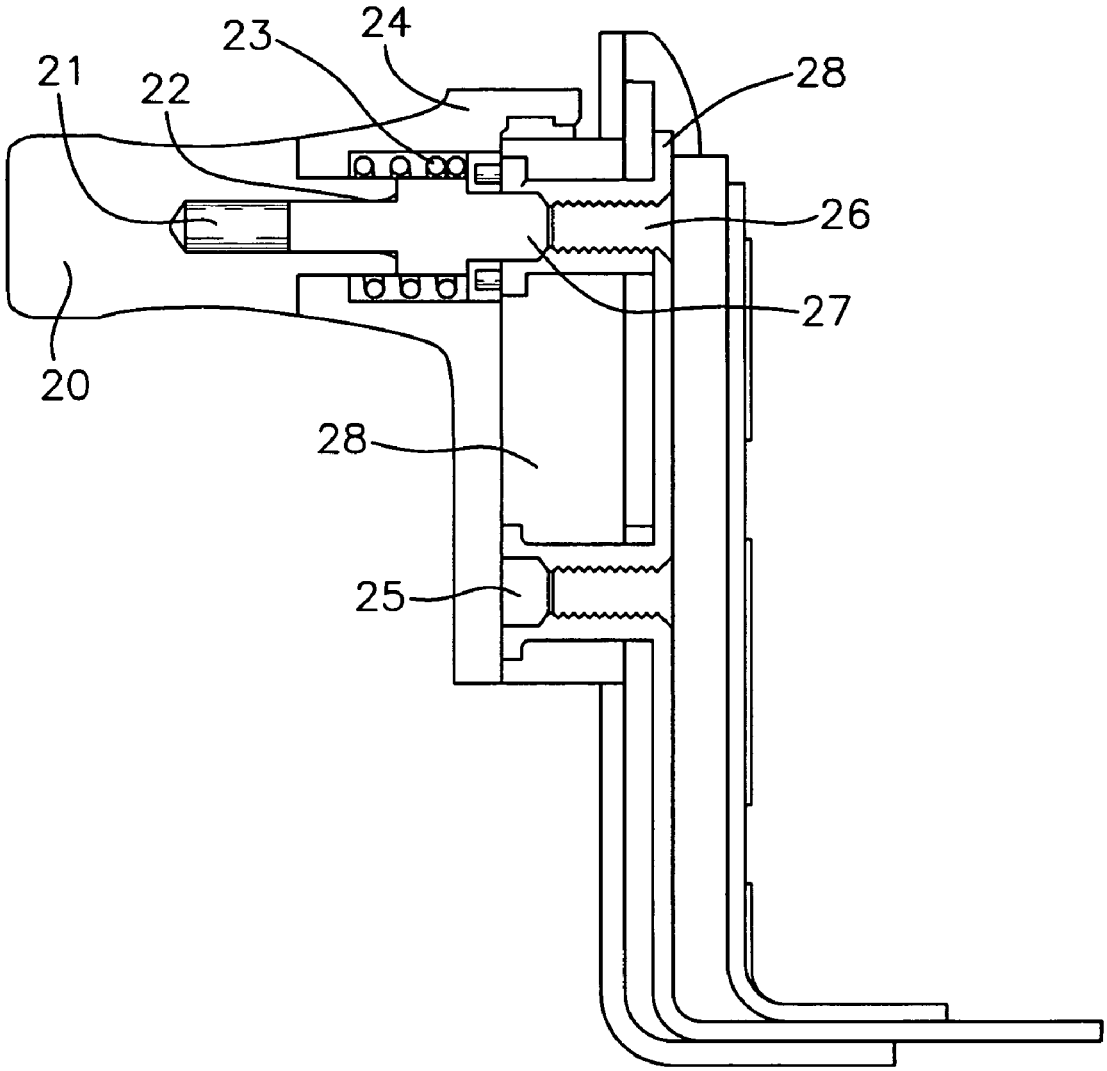
FIG. 2 is a cross sectional view of a preferred embodiment of the invention.

According to a preferred embodiment of the present invention, the footwear 10 contains a retainer 11 (see also FIG. 2, item 28; FIG. 5, item 52; and FIG. 6, item 62) and backing plate 18 that are built into the footwear either at the time of manufacture or as an addition to the boot. The retainer 11 is attached by conventional means such as insert fasteners 14 which attach to the backing plate 18 using conventional screws (not shown here) fixably attaching the retainer 11 to the butt of the boot 10. The retainer 11 is specially adapted to attach the base 12 and hold said base 12 in place. The retainer 11 is mounted vertically on the footwear to provide enhanced stability and allow for positioning of the spur 16 in either the upper or lower position as desired by the user. As described in greater detail herein below, the spur 16 and base 12 are adapted to be removably attached.

Referring now to FIG. 2 there is shown a cross-sectional side view of a preferred embodiment of the spur system. The spur 20 is removably attached to the base 24 using a spring 23 and plunger 27 built into the base. As an alternative embodiment the spring 23 can be replaced by any number of devices such as an elastic contrivance or mechanical device, usually consisting of a strip or plate of steel (or a number of these) suitably shaped or adjusted, which, when compressed, bent, coiled, or otherwise forced out of its normal shape, possesses the property of returning to it. The spur 20 contains a machined hollowed void 21 with a narrowed lip 22 around the inner annulus of the mating end of the spur 20. The plunger 27 is a machined smoothed elongated cylindrical part with portions of varying diameters to fit inside the base 24, spur void 21 and one of the two retainer voids 25 while engaging the spring 23 to provide tension and resistance against the plunger. The retainer 28 and base 24 similarly attach by means of a slotted slide mechanism (not shown in this view) and is held in place by the rear portion of the spring loaded plunger 27 when aligned with the retainer void 25. Retainer void 25 is formed by hollowing the fastener holding the retainer to the boot, but may also be formed in the retainer as separate voids apart from the fastening means used to attach the retainer to the boot.

Figure 4:
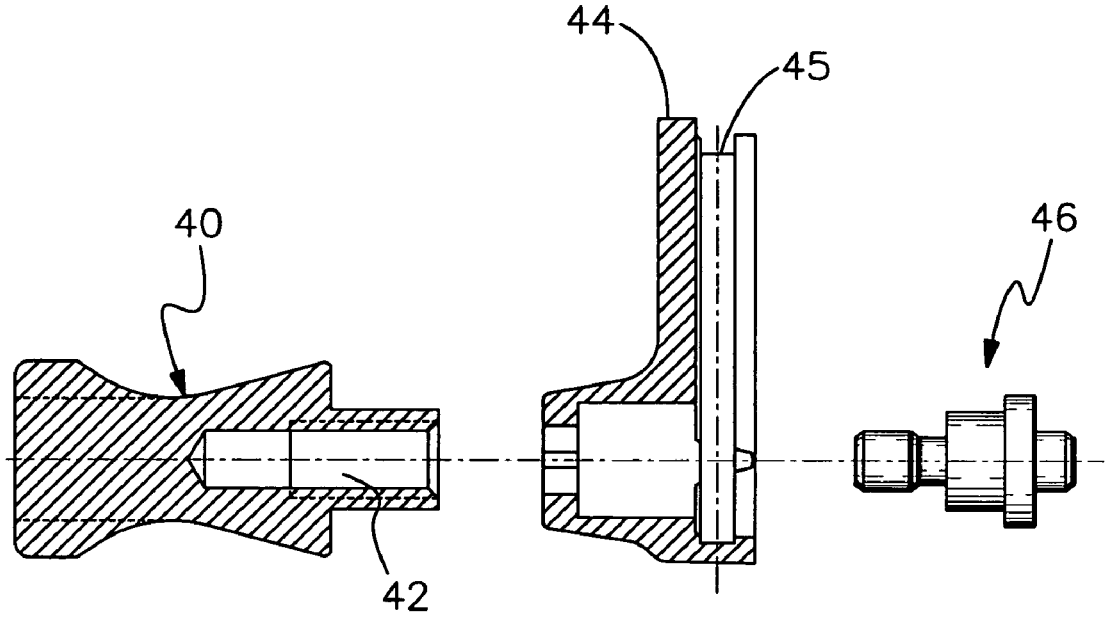
FIG. 4 is an exploded cross sectional view of a preferred embodiment of the invention.

As is readily apparent, the spur assembly can be engaged with the spur in a top position as shown in FIG. 2, or in a bottom position as shown in FIG. 4. Either way, the plunger engages one of the two voids 25 upon sliding the spur assembly over the T-shaped retainer. Other configurations of mating the spur assembly to the retainer are feasible and it is well known in the art how to make such reciprocal connections.

Because spur 20 is a separate piece from the base and plunger it is replaceable and may be of any of a variety of configurations. Spur 20 can be replaced with any one of many different shapes (e.g., longer, angled or bent, or a wheel/disc) by removing the plunger. The user could thus have several spur assemblies with different spur ends.

In an alternative embodiment, the base could have two plungers that engage each of the two voids 25, where the second plunger is contained entirely within the base and does not have a mating spur. This could provide an additional engagement point and provide for greater stability which may be desired in certain circumstances.

Figure 3A:
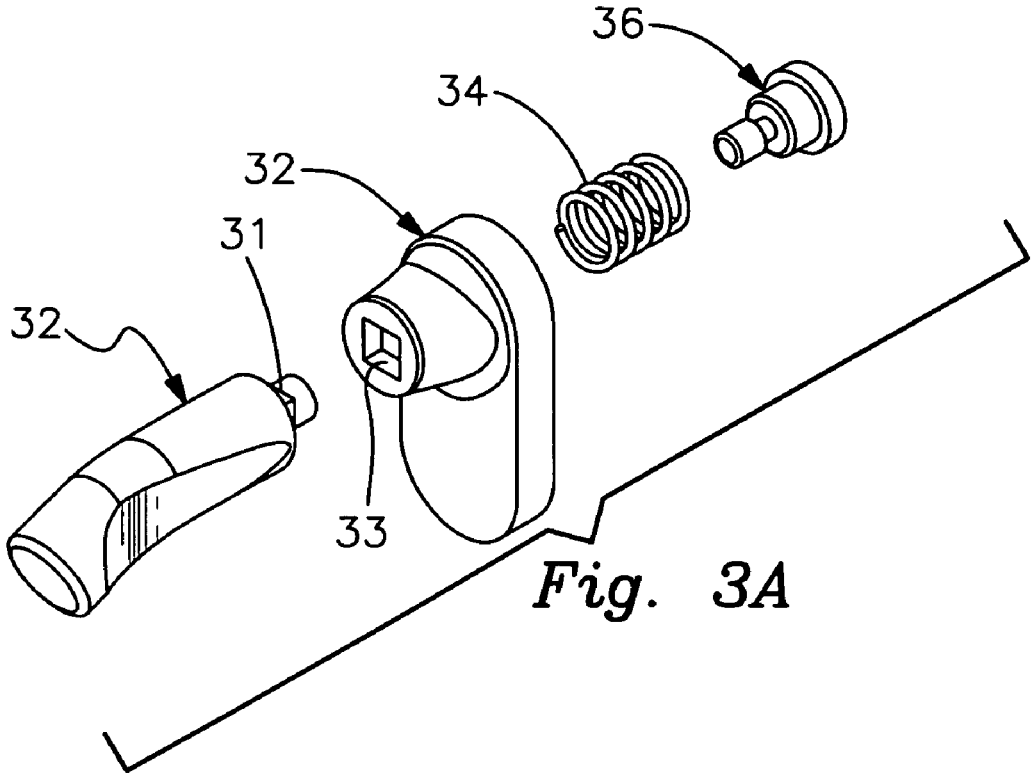
FIG. 3A is an exploded view of a preferred embodiment of the invention.

FIG. 3A shows an exploded perspective view of a preferred embodiment of the invention with the spur 30, base 32, spring 34 and plunger 36 shown. The plunger 36 and spring 34 are housed and placed in position inside the base 34 during manufacture. The plunger 36 has a degree of freedom of movement and will snap into place when aligned with either of the two fastener voids aligned inside the retainer. In one embodiment, the plunger 36 spring 34 and fastener voids act in concert as a spring lock, a common form of lock in which a spring presses the bolt outwards, thus rendering it self-locking except when secured by a catch. The spur 30 snaps into the base 32 and is held in place by the plunger 36 end and the narrowed lip inside the mating end of the spur 30. The spur 30 can be of any variety of shapes and is detachable and replaceable. The spur 30 as shown in FIG. 3A is longer, angled or bent down, a preferred embodiment that is used in dressage events for equestrian competitions. Spur 30 may also be engaged in an upwardly angled position. Shank 31 on spur 30 engages void 33 in base 32 through a reciprocally mating square configuration on both the void and the shank. Other reciprocal mating configurations may be used such as a star, a rectangle, or other polygonal shapes that inhibit rotational movement of spur 30 when engaged on base 32.

The spur can be angled, bent or offset, with a polygonal shaped mating end on the spur and reciprocal mating receptacle on the base to prevent rotation of the angled spur. The angled or offset spur ends provide numerous spur configurations including but not limited to an upward or downward angled spur end in an upper location mounted on the retainer as well as and upward or downward angled spur end in a lower location mounted on the retainer. In the context of this invention a dressage spur is a spur with an elongated spur end which may include but is not limited to a spur with an angled end and may be used in dressage events for equestrian competitions.

Figure 3B:
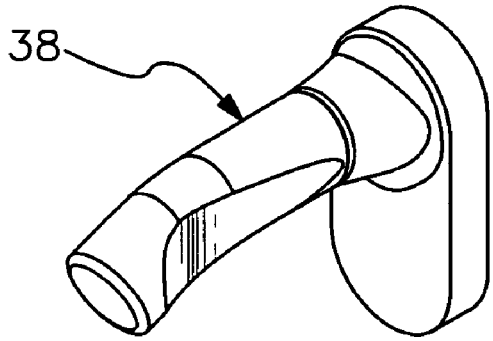
FIG. 3B is a perspective view of a preferred embodiment of the invention.

FIG. 3B shows the spur and base attached as a single piece 38. It can be attached to the retainer in either the up spur position or down spur position since the spring lock can engage either of the two voids in the retainer as shown in FIG. 1.

FIG. 4 shows a cross sectional exploded view of the spur 40, base 44 and plunger 46. For clarity, the spring or other counter biasing means is not shown. As described above and seen more easily here the machine hollowed void 42 inside the spur 40 allows the plunger 46 to snap into place when the spur is aligned with the base and sufficient force is applied to the spur 40 against the base. Also shown is the base slot or notch 45, which allows the base 44 to fixably attach to the retainer. The plunger may be engaged to the spur through conventional frictional attachment due to the configuration of the spur or in alternate embodiments may be reciprocally threaded or attached in any of a variety of methods.

Figure 5A:
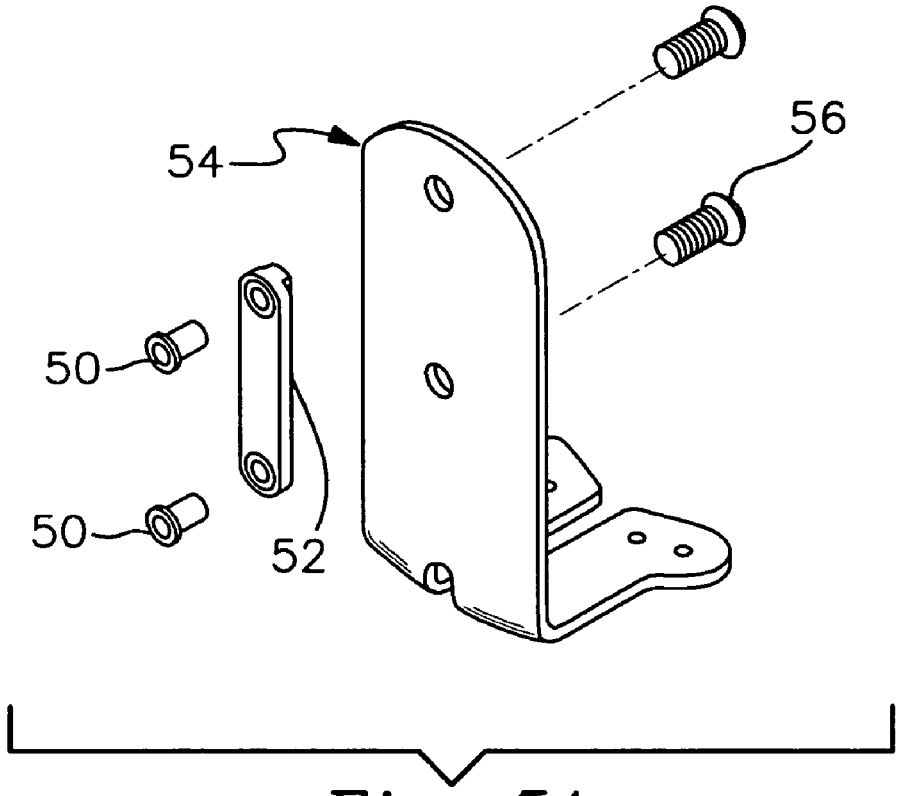
FIG. 5A is an exploded perspective view of a preferred embodiment of the invention.
Figure 5B:
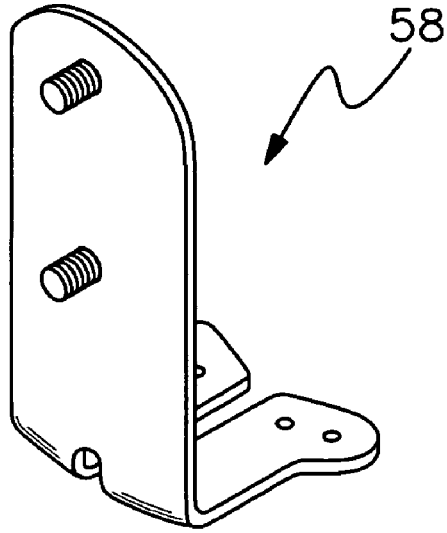
FIG. 5B is a perspective view of a preferred embodiment of the invention.

FIG. 5A is an exploded perspective view of the retainer 52, fasteners 50, backing plate 54 and fastening screws 56. FIG. 5B shows the fastening screws installed into the backing plate 58. The retainer 52 has one or two lips extending on either or both sides giving the cross section the appearance of a T and matching the slots or notches on the base. The retainer 52 allows the base to slide perpendicular to the butt of the footwear and vertical in relation to backing plate 52. The fasteners 50 and retainer 52 are attached to the backing plate 54 using the fastening screws 56. This is normally done during the footwear manufacturing process.

Figure 6:
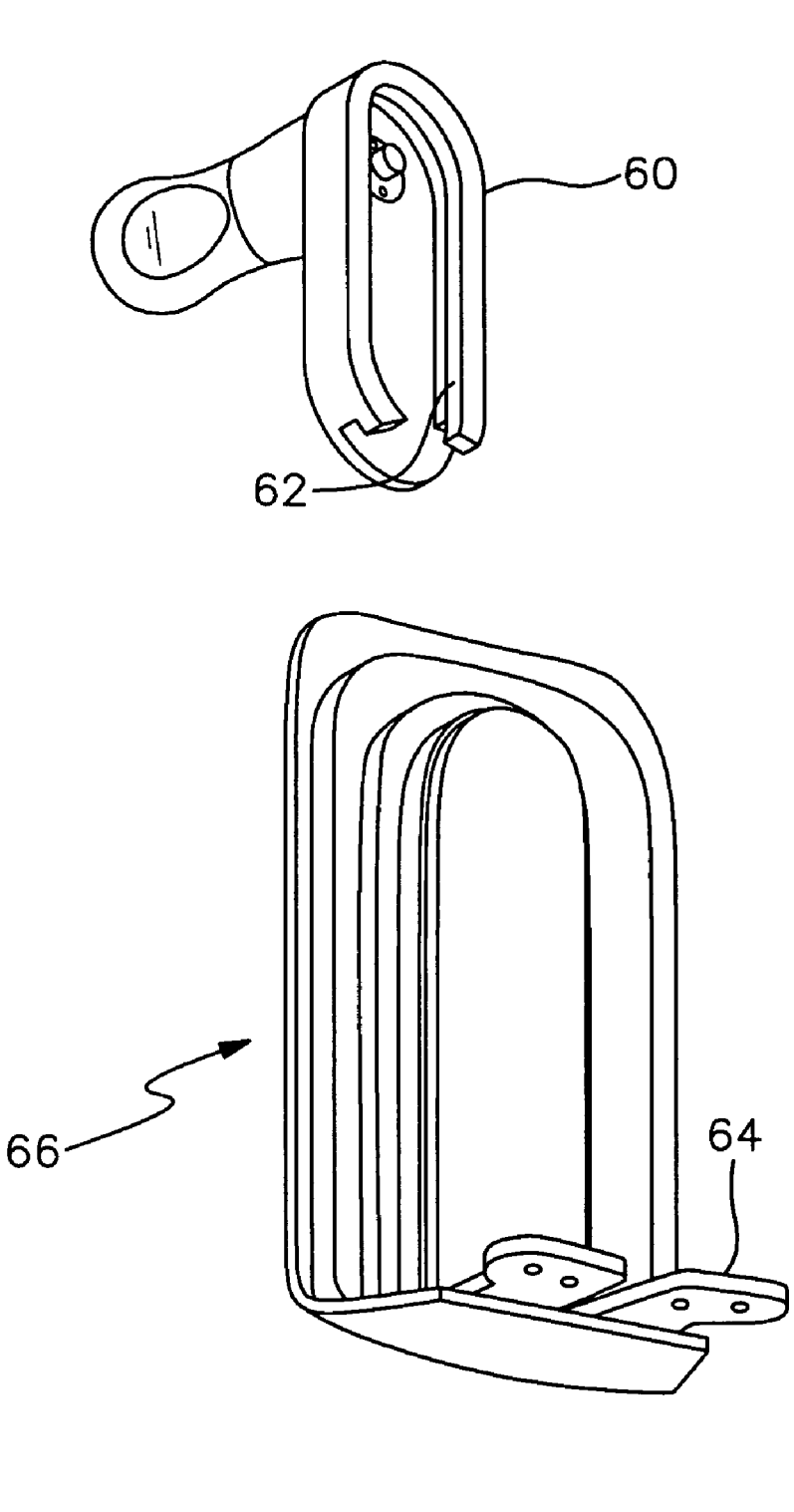
FIG. 6 is a perspective view of a preferred embodiment of the invention.

FIG. 6 shows the base 60 with plunger end extended and spur attached. The base 60 slides over the retainer and is held in place by the slotted lip 62 machined into the base 60. FIG. 6 also shows the butt 66 of the footwear and an exposed portion of the backing plate 64. Built up areas are for illustrative purposes and represent a cutaway of portions of the footwear covering portions of the backing plate 64.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

The invention claimed is:

1. A strapless spur system comprising:

a retainer vertically fixed into an upper of an article of footwear;

a spur assembly comprising a spur connected to a base for attachment to said retainer;

a spring biased plunger pin in said base for releasable engagement of said spur assembly to a void in said retainer;

wherein the base and retainer have a reciprocal cross sectional configuration for engagement to each other; and wherein said spur assembly can engage the retainer with the spur in a top position so that the spur projects from the strapless spur system at an upper position or can engage the retainer in a bottom position so that the spur projects from the strapless spur system in a lower position.

2. A strapless spur system as claimed in claim 1 wherein said retainer is integrated into said upper during manufacture of the footwear.

3. A strapless spur system as claimed in claim 1 wherein said configuration is a reciprocal T-shaped cross section between said base and said retainer.

4. A strapless spur system as claimed in claim 1 wherein said spur is angled downward upon engagement with said base.

5. A strapless spur system as claimed in claim 1 where said base and retainer have a reciprocal cross sectional configuration in the shape of a polygon for engagement to each other.

6. A strapless spur system comprising:

a retainer fixed into an upper of an article of footwear;

a spur assembly having a spur and a base for stable attachment to said retainer;

a spring biased plunger pin in said base for stable attachment of said base to said retainer;

said base and said retainer each having a reciprocal cross sectional configuration to engage each other;

said plunger pin being adapted for stable engagement into a void in said retainer; and said spur assembly engaging the retainer with the spur in a top position so that the spur projects from the strapless spur system at an upper position or said spur assembly engaging the retainer in a bottom position so that the spur projects from the strapless spur system in a lower position.

7. A strapless spur system as claimed in claim 6 wherein said spur assembly engages said retainer in one of a plurality of voids on the retainer.

8. A strapless spur system claimed in claim 6 wherein said spur has a polygonal shaped mating end and said base has a reciprocal mating receptacle.

9. A strapless spur system as claimed in claim 6 wherein said spur is angled downward upon engagement with said base.

10. A strapless spur system as claimed in claim 6 wherein said retainer has an upper and lower void either of which is capable of engaging with said pin.

11. A strapless spur system as claimed in claim 6 wherein said cross sectional configuration is T-shaped.

12. A strapless spur system comprising:

a retainer fixed into an upper of an article of footwear;

a spur assembly having a spur and a base for stable attachment to said retainer;

a spring biased plunger pin in said base for stable attachment of said base and to said retainer;

said base engages said retainer;

said spur being adopted for stable engagement to said base; and said spur assembly engaging the retainer with the spur in a top position so that the spur projects from the strapless spur system at an upper position or said spur assembly engaging the retainer in a bottom position so that the spur projects from the strapless spur system in a lower position.

13. A strapless spur system as claimed in claim 12 wherein said spur assembly engages said retainer in a void on the retainer.

14. A strapless spur system as claimed in claim 12 wherein said spur assembly engages said retainer in one of a plurality of voids on the retainer.

15. A strapless spur system as claimed in claim 12 wherein said spur has a polygonal shaped mating end and said base has a reciprocal mating receptacle.

16. A strapless spur system as claimed in claim 12 wherein said spur has a downward angle relative to said base upon engagement with said base.

17. A strapless spur system as claimed in claim 12 wherein said retainer has an upper and lower void either of which is capable of engaging with said spring lock.

18. A strapless spur system as claimed in claim 12 wherein the base and retainer have a reciprocal cross sectional configuration for locking engagement to each other.

19. A strapless spur system as claimed in claim 12 wherein said spur has an upward angle relative to said base upon engagement with said base.

* * * * *